United States Patent [19]

Hatfield

[11] Patent Number: 4,949,909

[45] Date of Patent: Aug. 21, 1990

[54] PIPE COIL DISPENSING RACK

[76] Inventor: Steven D. Hatfield, 5242 Pawnee, Lincoln, Nebr. 68506

[21] Appl. No.: 416,427

[22] Filed: Oct. 3, 1989

[51] Int. Cl.[5] ..... B65H 49/28; B65H 16/00

[52] U.S. Cl. ..... 242/86.2; 242/54 R; 242/86.5 R; 405/174

[58] Field of Search ..... 242/54 R, 83, 78.6, 242/86, 86.1, 86.2, 86.5 R, 77.2; 137/355.12, 355.16, 355.19, 355.26, 355.27, 355.2; 405/174–183

[56] References Cited

U.S. PATENT DOCUMENTS

| | | | |
|---|---|---|---|
| 848,239 | 7/1906 | Grimsrud | 242/86.2 |
| 2,896,877 | 7/1959 | Vaughn | 242/86.5 R |
| 3,902,520 | 9/1975 | Gallenberg | 137/355.16 X |
| 4,143,826 | 3/1979 | Lamperti | 242/54 R |
| 4,768,732 | 9/1988 | Greenleaf | 242/86.5 R |

*Primary Examiner*—Stuart S. Levy
*Assistant Examiner*—Steven M. duBois
*Attorney, Agent, or Firm*—Vincent L. Carney

[57] ABSTRACT

To provide an improved pipe coil rack for dispensing pipe from a coil, the pipe coil dispensing rack comprising: (1) a frame having a turntable bearing, a cross bar, legs, wheels and a tongue; (2) a turntable rotatably mounted to the turntable bearing; and (3) a pipe guide ring secured to the frame. The turntable includes a pipe reel hold down assembly secured to the turntable with a resilient rubber strap and spacers removably secured to the turntable and to the pipe reel hold down assembly. The pipe coil dispensing rack may be positioned for use horizontally by positioning the wheels and the tongue on the ground; or the pipe coil dispensing rack may be positioned for storage vertically by positioning wheels and the cross bar on the ground. The pipe coil dispensing rack is suitable for one-man use and provides for the uncoiling of pipe from the pipe coil directly at the site to eliminate errors in cutting the pipe prior to use.

20 Claims, 3 Drawing Sheets

PIPE COIL DISPENSING RACK

BACKGROUND OF THE INVENTION

This invention relates to a pipe coil dispensing rack and method of using it.

Flexible pipe is installed in the ground using automatic equipment that forms an opening in the ground and pulls the flexible pipe through the opening. It is known to feed the pipe from a fixed location as the pipe puller moves the pipe through the ground.

In a prior art method of feeding the pipe, a worker feeds the pipe manually from a coil. This method has a disadvantage in that it is difficult to manage the heavy coil and uses an excessive amount of time and effort of the worker.

SUMMARY OF THE INVENTION

Accordingly, it is an object of this invention to provide a novel pipe coil dispensing rack.

It is a further object of this invention to provide a novel pipe dispensing rack which accommodates pipe coils having different inside coil diameters.

It is another object of this invention to provide a novel pipe dispensing rack having wheels and a handle positioned on the rack frame for convenient movement of the pipe dispensing rack.

It is another object of this invention to provide a novel pipe dispensing rack capable of convenient movement to either a horizontal position for use or a vertical position for storage.

It is yet another object of this invention to provide a novel pipe dispensing rack wherein the pipe guide ring may be positioned at different locations on the frame to accommodate the pulling of the pipe from the coil at different directions from the rack to suit various site limitations.

It is still another object of this invention to provide a novel pipe dispensing rack wherein the pipe reel hold down assembly is removably secured to the turntable by a resilient tie down strap secured between the turntable and the pipe reel hold down assembly.

It is a still further object of the invention to provide a pipe coil dispensing rack suitable for one man operation.

It is a still further object of the invention to provide a novel method of laying pipe and for uncoiling a pipe coil at the maintenance or construction site as needed.

In accordance with the above and further objects of the invention, a pipe coil dispensing rack has a frame, a turntable and a pipe guide ring. The frame includes two wheels, two corresponding legs for the wheels, a cross bar connecting the legs and a tongue connected to the cross bar and supporting a rotatable bearing for the turntable. The frame may be moved from place to place on the wheels by pushing or pulling on the tongue. The frame rests on the wheels and tongue or stands vertical for storage on the wheels and cross bar.

The turntable includes: (1) radially extending horizontal spoke members to support a coil of hose or pipe; (2) a centrally located turntable bearing resting upon the tongue of the frame and adapted to permit rotation of the turntable; and (3) vertical uprights for receiving spacers that establish the area holding the coil and support a hold down assembly that controls the space for the pipe to provide for orderly removal through the guide ring. The pipe guide ring may be positioned at different locations on the frame to accommodate the pulling of the pipe from the coil at different directions from the rack to suit various site limitations. The pipe reel hold down assembly is removably secured to the turntable by a resilient tie down strap secured between the turntable and the pipe reel hold down assembly.

To position the coil dispensing rack for use, it is moved wheelbarrel-like on its wheels by holding the tongue. It is stabilized at the site by pulling the telescoping tongue out and resting its downwardly extending end on the ground.

To use the pipe coil dispensing rack, the pipe reel hold down assembly is removed from the rack, and a pipe coil of the proper size and diameter is placed upon the turntable, with the inner diameter of the pipe coil supported upon the turntable by turntable uprights, which are preferably adjustably positioned on the turntable to accommodate large or small inside coil diameters.

Once the pipe coil is properly positioned upon the turntable, the pipe coil is secured to the turntable by positioning the pipe reel hold down assembly about the pipe coil, and securing the pipe reel hold down assembly to the turntable with a suitable resilient rubber strap.

The pipe end extending from the coil is routed through the pipe guide ring, and adjustably positioned in relation to the frame to allow the pipe to be pulled from the rack directly to the location desired. The rotating turntable allows the pipe to be unwound from the coil without twisting or kinking the pipe. The rack may be stored after use by moving it to the storage site and placing it in a horizontal or vertical position.

As can be understood from the above description, this invention has several advantages, such as for example: (1) it is of simple construction; (2) it is rugged and durable; (3) it may be easily moved and maneuvered to its location; (4) it accommodates pipe coils having different internal diameters; (5) it may be used at the site by one-man; (6) it keeps the pipe straightened and does not allow the pipe to become twisted while uncoiling; (7) it allows for unforeseen changes in measuring obstructions, providing needed adjustment in pipe length or location as the pipe is pulled from the coil; and (8) it can be stored in either a vertical or horizontal position.

SUMMARY OF THE DRAWINGS

The above noted and other features of the invention will be better understood from the following description when considered in connection with the accompanying drawings in which.

DETAILED DESCRIPTION

Figure 1:
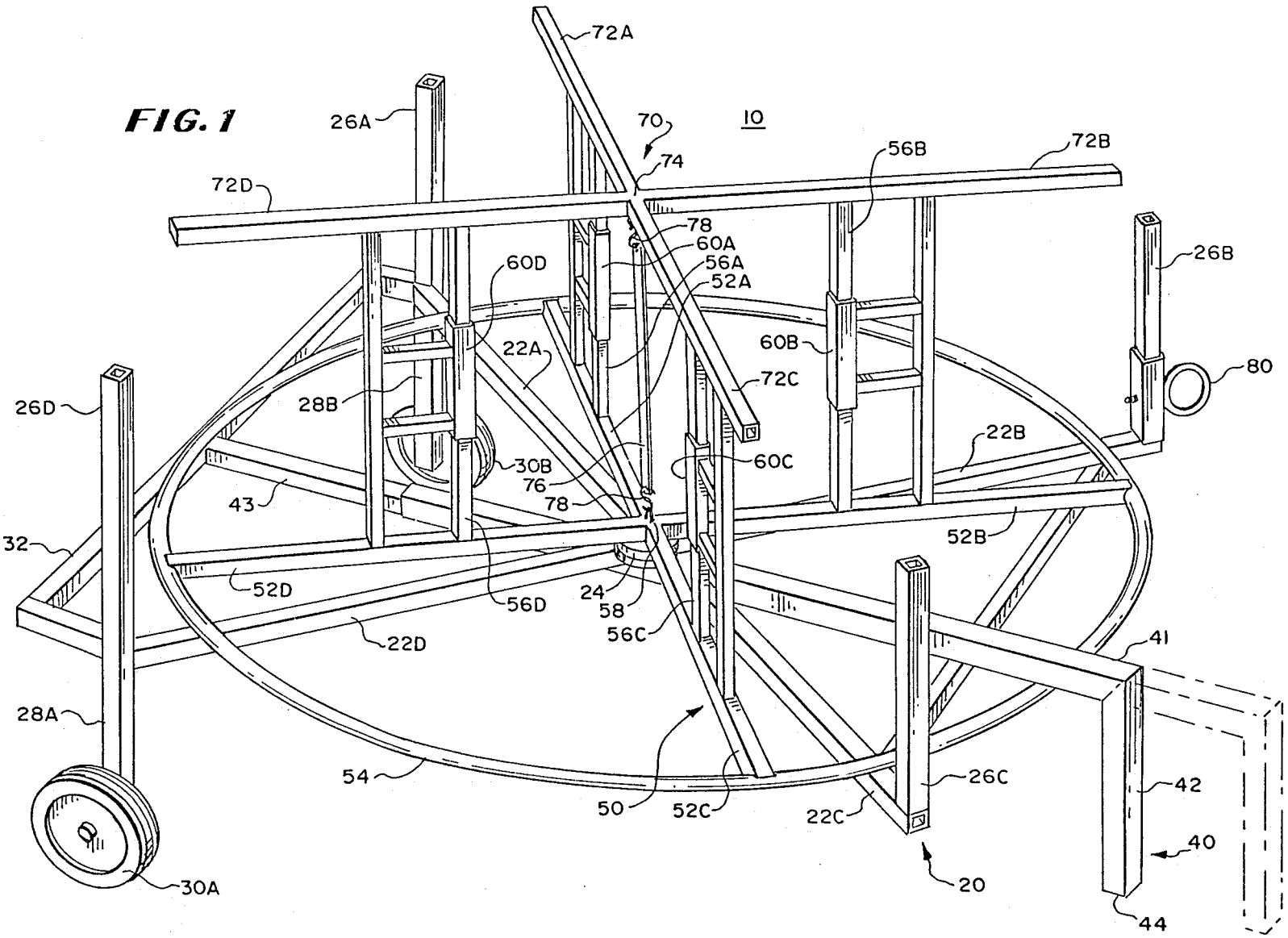
FIG. 1 is a perspective view of the pipe coil dispensing rack shown in a horizontal position, with the pipe coil removed from the pipe dispensing rack for clarity.

In FIG. 1, there is shown a perspective view of a pipe coil dispensing rack 10 having a frame 20, a turntable 50 and a pipe guide ring 80. The pipe coil dispensing rack 10 is shown in a horizontal position with the frame 20 rotatably supporting the turntable 50 to permit pipe to be pulled through the pipe guide ring 80 as the turntable 50 turns.

To support the turntable 50, the frame 20 includes two wheels 30A and 30B, two corresponding legs 28A and 28B, a cross bar 32 and a tongue 40. The wheels 30A and 30B are fastened at the lower end of the legs 28A and 28B respectively to permit movement of the frame 20 from place to place by pushing or pulling on the tongue 40 and to permit movement of the turntable 50 from a horizontal position in which it rests on the tongue 40 and wheels 30A and 30B to a vertical storage position in which it rests on the cross bar 32 and wheels 30A and 30B.

The wheels 30A and 30B are secured to the two legs 28A and 28B for rotational movement in parallel alignment to each other, with the cross bar 32 extending between the legs 28A and 28B. The cross bar 32 and the wheels 30A and 30B provide support for the pipe coil dispensing rack 10 when the pipe coil dispensing rack is vertically positioned.

Figure 3:
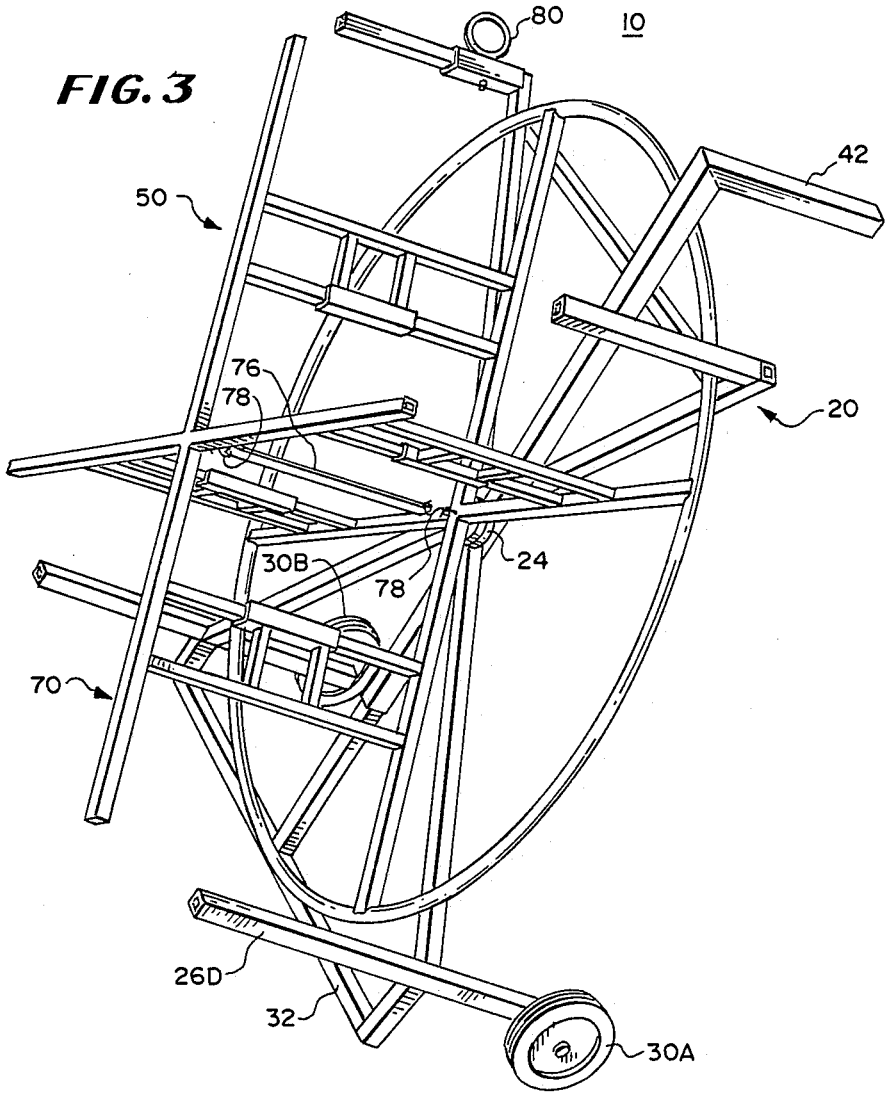
FIG. 3 is a perspective view of the pipe coil dispensing rack shown in a vertical storage position, with the pipe coil removed from the pipe dispensing rack for clarity.

The cross bar 32 is formed of square tubing welded into a "U" shaped member having a straight center portion and two side portions welded to it and the frame 20. The "U" shaped member is horizontal with the straight portion being spaced from the frame 20 and from the turntable 50 at a location opposite to the tongue 40 and between the two wheels 30A and 30B. Each of the two side portions of the "U" shaped member are fastened to a different one of the legs 28A and 28B, such as by welding. With this structure, an operator may tip the frame 20 vertical to support it on the wheels 30A and 30B and the central portion of the cross bar 32 by lifting on the tongue 40 for easier storage in a smaller space as shown in FIG. 3.

The tongue 40 is formed of square tubing in three sections, which are an outer bottom support section 41, an inner telescoping section 43 and a downwardly extending leg section 42. The outer bottom support section 41 is welded to the center of spoke members 22A–22D and extends in the plane of the cross bar 32 to the center of the frame 20 where it is rotatably mounted to the turntable 50. The inner telescoping section 43 is telescoped within the outer bottom support section 41 for the purpose of permitting the downwardly extending leg portion 42 to be pulled out with the inner telescoping section 43. The inner telescoping section 43 is of smaller cross section for that purpose and has its end secured to the downwardly extending leg 42. The downwardly extending leg section 42 is sized so that the end 44 remote from the inner telescoping section 43 and the wheels 30A and 30B support the frame 20 when the frame 20 is in a generally horizontal position.

The turntable 50 includes: (1) radially extending horizontal spoke members 22A–22D; (2) a turntable bearing 24; (3) vertical uprights 26A–26D; (4) spacers 60A–60D; and (5) a hold down assembly 70. The turntable bearing 24 is centrally disposed beneath the radially extending horizontal spoke members 22A–22D and above the outer bottom support section 41 of the tongue 40 to permit turning of the turntable 50 with respect to the frame 20 on the turntable bearing 24. A corresponding one of the vertically disposed uprights 26A–26D extends above each of the ends of the spoke members 22A–22D, with two vertically disposed legs 28A and 28B extending below the end of two of the spoke members 22A and 22D.

Figure 2:
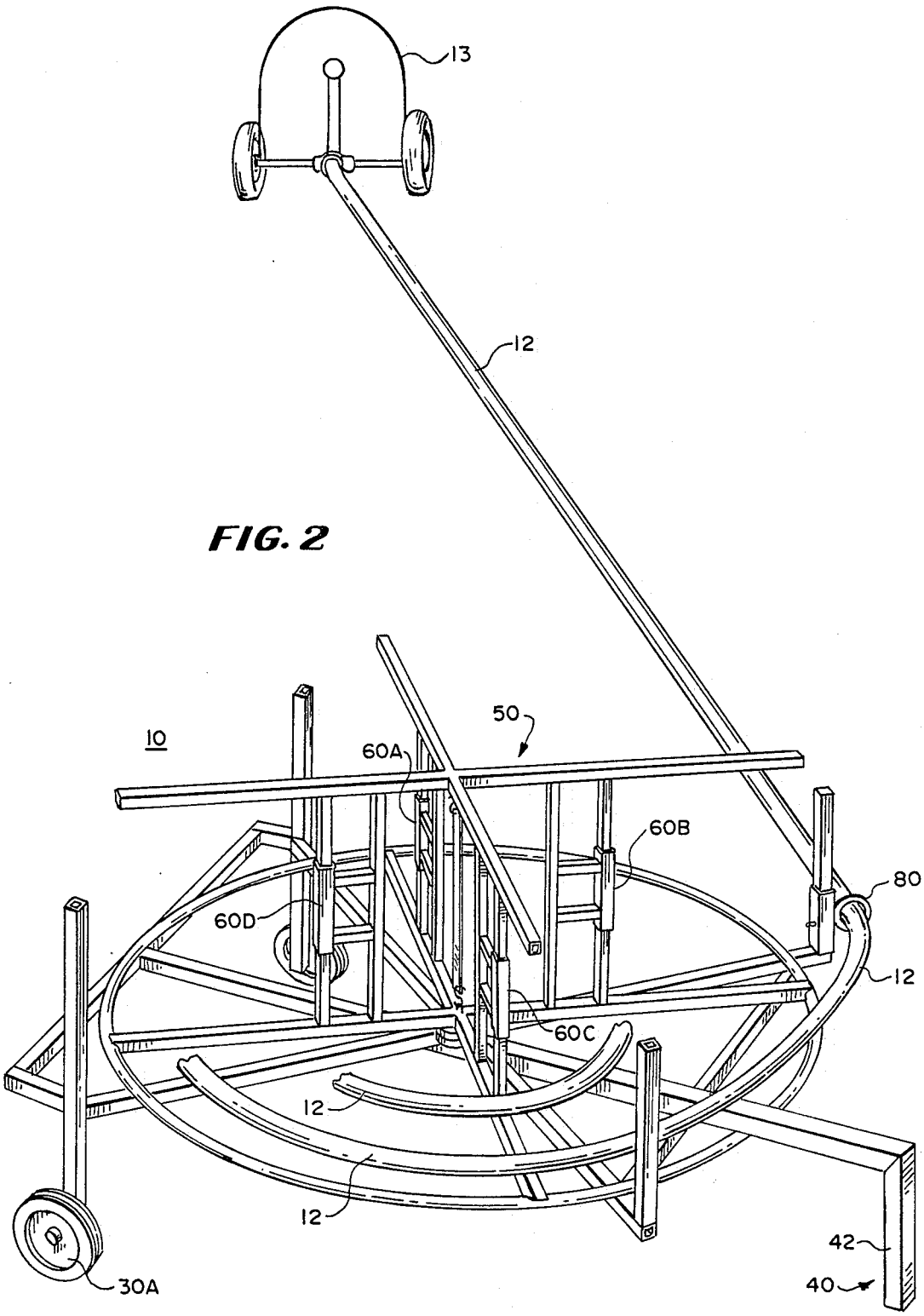
FIG. 2 is a fragmentary simplified perspective view of the pipe coil dispensing rack shown in a horizontal position, with a pipe coil installed on the turntable in position to be pulled through the ground.

The turntable 50 is supported for rotational movement about the turntable bearing 24. The turntable 50 has radially extending turntable arms 52A–52D extending from the turntable bearing 24, with an annular ring 54 disposed at the ends of the turntable arms 52A–52D. Turntable arms 52A–52D are preferably sized to extend substantially to the outer diameter of the pipe coil 12 (FIG. 2), when the pipe coil (FIG. 2) is mounted upon the turntable 50 as shown in FIG. 2.

Extending from turntable arms 52A–52D are turntable uprights 56A–56D, which are positioned to receive the corresponding spacers 60A–60D. The spacers 60A–60D are preferably replaceably positioned upon turntable uprights 56A–56D, so that the spacers 60A–60D may be raised from uprights 56A–56D and removed for a large internal pipe coil diameter or placed as shown in FIG. 1 for a narrower pipe coil diameter requiring less room. The inner diameter of a large pipe coil may be, for example, 31 inches in inside diameter. Because the pipe coil dispensing rack 10 is adapted to receive pipe coils of different internal diameters, it may accommodate different lengths of pipe and different pipe diameters on the same pipe coil dispensing rack 10 as is described further in connection with FIG. 4.

The pipe reel hold down assembly 70 has hold down arms 72A–72D extending radially from a central axis 74. The hold down arms 72A–72D: (1) are positioned above turntable arms 52A–52D; (2) sized to engage turntable uprights 56A–56D when a pipe coil 12 is mounted upon turntable 50; (3) are positioned above turntable arms 52A–52D; and (4) preferably engage spacers 60A–60D extending from turntable uprights 56A–56D to secure the spacers 60A–60D during use.

The pipe reel hold down assembly 70 is preferably removably secured to turntable 50 with a resilient rubber strap 76 extending between central axis 74 of the hold down assembly 70 and central axis 50 of the turntable 50. The resilient rubber strap 76 is preferably releasably secured between the hold down assembly 70 and the turntable 50 with an S-hook 78 at the bottom of the center axis 58.

The pipe guide ring 80 is secured to one of the vertical uprights 26B. Preferably, the pipe guide ring 80 is adjustably secured to any one of several uprights 26A–26D to suit the direct dispensing of straightened pipe from the turntable 50 to the point of use. The pipe guide ring 80 may be adjustably secured to any one of the uprights 26A–26D with a threaded T-bolt, or by other known adjustable securing means.

The frame 20, tongue 40, turntable 50, spacers 60A–60D and hold down assembly 70 may be fabricated of conventional material such as steel or aluminum, and may be secured by any conventional means, such as welding.

In FIG. 2, there is shown a fragmentary simplified perspective view of a pipe dispensing rack 10 holding a plastic pipe 12 for insertion in the ground by a pipe puller 13. The pipe puller 13 may be any type of pipe puller known in the art such as the Pipe Piper brand sold by Turfco Manufacturing Incorporate, 3456 Washington Avenue North, Minneapolis, MN 55412-2688 and is not itself part of the invention but the pipe dispensing rack described herein is intended to cooperate with such a pipe puller.

As best shown in FIG. 2, one end of the pipe 12 is attached to the pipe puller 13 and the pipe itself is coiled on the pipe dispensing rack 10 with the pipe 12 passing through the pipe guide ring 80. The downwardly extending leg section 42 of the tongue 40 is pulled outwardly for stability and under some circumstances ease in moving the pipe dispensing rack 10. In this view, the spacers 60A–60D are turned to enlarge the area between the spacers and the legs for the coil.

In FIG. 3, there is shown a perspective view of the pipe dispensing rack 10 resting on the cross bar 32 and the wheels 30A and 30B for storage. For this purpose, the center of gravity of the pipe dispensing rack 10 must be between the cross bar 32 and the wheels 30A and 30B when the pipe dispensing rack is in the vertical position; the wheels must be spaced from each other and from the cross bar 32 a distance that permits slight angle on the surface of the ground so that the pipe dispensing rack 10 is stable when the center of gravity is moves to either side a slight distance when in the vertical position. For this purpose, the center of gravity should be within at least 4 inches of the distance between the cross bar 32 and the point of contact of the wheels 30A and 30B when the pipe dispensing rack is vertical in position.

Figure 4:
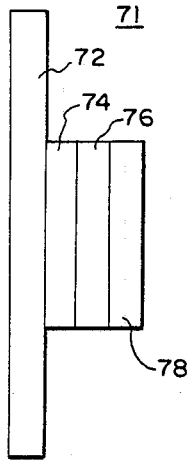
FIG. 4 is a perspective view of another embodiment of spacer used in the pipe coil dispensing rack in accordance with the invention.

In FIG. 4, there is shown an embodiment of spacer 71 slightly different than the spacers 60A–60D shown in FIGS. 1–3. In the embodiment 71, there is a post member 72 identical to that of the spacers 60A–60D and three sleeves 74, 76 and 78 sized to fit over the turntable uprights 56A–56D whereas in the spacers 60A–60D only one sleeve is used. In the embodiment of FIG. 4, any one of the sleeves 75, 76 and 78 may be positioned over one of the turntable uprights 56A–56D and this selection changes the volume available for the pipe 12 by moving the post member 72 closer or further away from the turntable upright. In both embodiments, the post member 72 or its counterpart in the embodiments of FIGS. 1–3 may be positioned on either side of the turntable uprights over which it fits to change the volume available between the vertical uprights 26A–26D.

The bottom of the turntable 50 and the turntable bearing 24 should be between 8 and 24 inches from the ground and in the preferred embodiment is 15 inches. This distance is selected to permit easy movement on the wheels 30A and 30B. The diameter of the turntable 50 from its center to the outer edge of the spacers should be between 16 and 46 inches and is 22.5 inches in the preferred embodiment. The radial distance from the center to the inner surface of one of the vertical uprights 26A–26D should be between 22 and 60 inches and is preferably 47 inches.

In use, the pipe reel hold down assembly 70 is removed from turntable 50 by releasing one of the S-hooks 78 secured to resilient strap 76, and lifting hold down assembly 70 away from turntable 50. Spacers 60A–60D are positioned upon turntable 50 to suit the internal diameter of the pipe coil to be used. A pipe coil 12 of suitable size and length is then positioned upon turntable arms 52A–52D. This may be done in either the horizontal position shown in FIG. 1 or in the vertical position shown in FIG. 3. Next, the pipe reel hold down assembly 70 is positioned against the pipe coil 12 about the turntable uprights 56A–56D in spaced relation above the turntable arms 52A–52D, and secured in place with the resilient rubber strap 76 extending between the turntable central axis 58 and the tie down axis 74. The pipe coil dispensing rack 10 may then be maneuvered into position in close proximity to the work site to dispense pipe from the pipe dispensing rack 10 to suit the needs of the user. Pipe guide ring 80 is preferably positioned upon one of the vertical uprights 26, to dispense pipe from the pipe dispensing rack directly to the site where the pipe is needed, thus avoiding excessive bending or kinking of the pipe prior to installation at the site.

The pipe is pulled into position from the pipe dispensing rack 10 through the pipe guide ring 80. This may be done manually, or with a conventional remote pipe puller 13 (FIG. 2). Thus, the pipe coil dispensing rack 10 need not have an independent power source, or electrical, pneumatic or hydraulic controls to dispense straightened pipe from the pipe dispensing rack 12. This greatly simplifies construction and provides a pipe coil dispensing rack 10 of compact size and light weight which aids in the movement and positioning of the rack during transport, use or storage.

When positioned horizontally, tongue end 44 and wheels 30A and 30B support the pipe dispensing rack 10 for dispensing pipe 12 from the rack. The rack 10 may be easily maneuvered in the horizontal position by slightly raising tongue end 44 from engagement with the ground. When positioned vertically, cross bar 32 and wheels 30A and 30B support pipe dispensing rack 10.

As can be understood from the above description, this invention has several advantages, such as for example: (1) it is of simple construction; (2) it is rugged and durable; (3) it may be easily moved and maneuvered to its location; (4) it accommodates pipe coils having different internal diameters; (5) it may be used at the site by one-man; (6) it keeps the pipe straightened and does not allow the pipe to become twisted while uncoiling; (7) it allows for unforeseen changes in measuring obstructions, providing needed adjustment in pipe length or location as the pipe is pulled from the coil; and (8) it can be stored in either a vertical or horizontal position.

Although a specific embodiment of this invention has been described with some particularity, many modifications and variations in the embodiment are possible in light of the above teachings. Therefore, it is to be understood that within the scope of the appended claims, the invention may be practiced otherwise than as specifically described.

What is claimed is:

1. A pipe coil dispensing rack comprising:

a frame formed having a plurality of substantially horizontal spoke frame members; at least one vertically disposed upright extending above at least one of the plurality of horizontal spoke members, two vertically disposed legs extending below the horizontal spoke members with wheels disposed near the lower end of the vertically disposed legs;

a tongue secured to the frame with a tongue end downwardly disposed at one end of the tongue, the wheels and tongue end forming a supporting surface when the rack is positioned horizontally;

a turntable supported for rotational movement about a turntable bearing; the turntable having radially extending turntable arms extending from the turntable bearing with an annular ring disposed at the ends of the turntable arms; with turntable uprights extending in spaced relation from the turntable arms;

a pipe reel hold down assembly removably secured to the turntable uprights in spaced relation from the turntable arms; and a pipe guide ring secured above the spoke members upon one of the vertically disposed uprights.

2. The apparatus of claim 1, wherein spacers are disposed upon the turntable uprights to receive the inner diameter of a pipe coil mounted upon the turntable; said spacers used to center the pipe coil upon the turntable for ease of rotation about the turntable bearing.

3. The apparatus of claim 2, wherein the spacers are adjustably positioned upon the turntable uprights to accommodate pipe coils having large or small inner coil diameters.

4. The apparatus of claim 3, wherein the spacers are adjustably positioned by lifting the spacer off the turntable upright and rotating the spacer to the desired position, and lowering the spacer back down upon the turntable upright prior to positioning a pipe coil upon the turntable.

5. The apparatus of claim 2, wherein the pipe reel hold down assembly is adapted to secure the spacers upon the turntable uprights when the hold down assembly is mounted upon the turntable uprights.

6. The apparatus of claim 1, wherein the tongue has a telescoping portion to adjustably position the tongue in relation to the frame of the pipe coil dispensing rack.

7. The apparatus of claim 1, wherein a resilient rubber strap is releasably secured between the turntable and the pipe reel hold down assembly to removably secure the pipe reel hold down assembly to the turntable about a pipe coil mounted upon the turntable.

8. The apparatus of claim 7, wherein the resilient rubber strap extends above the turntable bearing between the turntable and the pipe reel hold down assembly near the axis of rotation of the turntable.

9. The apparatus of claim 1, wherein at least three vertically disposed uprights extend above the horizontal spoke members, and the pipe guide ring may be removably secured to any of the vertically disposed uprights for ease of positioning the pipe coil dispensing rack in relation to the unreeling location.

10. The apparatus of claim 9, wherein the pipe guide ring is removably secured and adjustably positioned upon one of the vertically disposed upright.

11. The apparatus of claim 1, wherein a pipe pulling machine is secured to the end of the pipe extending from a pipe coil, and the pipe pulling machine is used to pull the pipe from the coil mounted upon the turntable.

12. A pipe coil dispensing rack, comprising:

a frame formed of four radially extending horizontal spoke members with a turntable bearing centrally disposed thereon; two vertically disposed legs extending below the end of two of the horizontal spoke members with wheels disposed near the lower end of the legs; four vertically disposed uprights extending above each of the horizontal spoke members; and a cross bar extending from the legs with a straight portion extending across the rear of the frame; the wheels and cross bar forming a supporting surface when the rack is positioned vertically;

a tongue adjustably secured to the frame, with a tongue end downwardly disposed at one end of the tongue, the wheels and tongue end forming a supporting surface when the rack is positioned horizontally;

a turntable supported for rotational movement about the turntable bearing; the turntable having four radially extending turntable arms with an annular ring disposed at the ends of the turntable arms with four turntable uprights extending from the turntable arms;

a pipe reel hold down assembly removably secured to the turntable uprights in spaced relation from the turntable arms; and a pipe guide ring secured to one of the vertically disposed uprights extending above the radially extending turntable arms extending from the frame; wherein the wheels are positioned upon the frame to provide ease of movement of the pipe coil dispensing rack in either a generally vertical or horizontal position.

13. The apparatus of claim 12, wherein spacers are disposed upon the turntable uprights to receive the inner diameter of pipe coil mounted upon the turntable; said spacers used to center the pipe coil upon the turntable for ease of rotation about the turntable bearing.

14. The apparatus of claim 13, wherein the spacers are adjustably positioned upon the turntable uprights to accommodate pipe coils having large or small inner coil diameters.

15. The apparatus of claim 13, wherein the spacers are adjustably positioned by lifting the spacer off the turntable upright and rotating the spacer to the desired position, and lowering the spacer back down upon the turntable upright prior to positioning a pipe coil upon the turntable.

16. The apparatus of claim 13, wherein the pipe reel hold down assembly is removably secured to the turntable with a resilient rubber strap extending between the turntable and the pipe reel hold down assembly in proximity to an axis of rotation of the turntable bearing.

17. The apparatus of claim 12, wherein the tongue is adjustably positioned in relation to the frame.

18. The apparatus of claim 12, wherein a pipe pulling machine is secured to the end of the pipe extending from a pipe coil and the pipe pulling machine is used to pull the pipe from the coil mounted upon the turntable.

19. A method of laying plastic pipe comprising the steps:

removing a hold down assembly from the top of a turntable supported on a frame;

placing a coil of pipe on the turntable between outer turntable uprights and inner spacer members;

threading the pipe through a guide ring and attaching it to a pipe puller;

utilizing the pipe puller to prepare a small trench as it pulls the pipe through the trench; and cutting the pipe to the proper length after it has been laid in the trench.

20. A method according to claim 19 in which the turntable and frame are moved to the contruction site by rolling it on wheels attached to the frame held by outwardly extending legs.

* * * * *